US010734740B2

(12) United States Patent
Yamanaka et al.

(10) Patent No.: US 10,734,740 B2
(45) Date of Patent: Aug. 4, 2020

(54) PRESS-FIT TERMINAL

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP)

(72) Inventors: Takuya Yamanaka, Yokkaichi (JP); Tetsuya Ito, Yokkaichi (JP); Kazumasa Kobayashi, Yokkaichi (JP); Yuichi Nakanishi, Yokkaichi (JP); Shigeki Shimada, Osaka (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/339,034

(22) PCT Filed: Oct. 4, 2017

(86) PCT No.: PCT/JP2017/036107
§ 371 (c)(1),
(2) Date: Apr. 3, 2019

(87) PCT Pub. No.: WO2018/070318
PCT Pub. Date: Apr. 19, 2018

(65) Prior Publication Data

US 2020/0044373 A1 Feb. 6, 2020

(30) Foreign Application Priority Data

Oct. 12, 2016 (JP) ..... 2016-200607
Jul. 18, 2017 (JP) ..... 2017-138871

(51) Int. Cl.
*H01R 9/24* (2006.01)
*H01R 12/58* (2011.01)

(52) U.S. Cl.
CPC ..... *H01R 12/58* (2013.01)

(58) Field of Classification Search
CPC ..... H01R 12/58; H01R 12/585; H01R 12/71; H01R 12/727; G01D 11/245
(Continued)

(56) References Cited

U.S. PATENT DOCUMENTS 4,867,710 A * 9/1989 Harting ..... H01R 12/585 439/751
5,639,249 A * 6/1997 Lenoir ..... H01R 12/727 439/686
(Continued)

FOREIGN PATENT DOCUMENTS

JP 1-232674 9/1989
JP 2004-127610 4/2004
(Continued)

OTHER PUBLICATIONS

International Search Report dated Jan. 9, 2018.

*Primary Examiner* — Jean F Duverne
(74) *Attorney, Agent, or Firm* — Gerald E. Hespos; Michael J. Porco; Matthew T. Hespos

(57) ABSTRACT

A press-fit terminal includes an end part that is to be inserted into a through-hole of a circuit board. The end part is connected electrically to the through-hole by being in elastic contact with an inner wall of the through-hole. The press-fit terminal also includes a base part opposite to the end part. Two elastic contact pieces are between the end part and the base part and are disposed to face each other through an opening. A stress dispersion part is provided in at least one of a region that includes a border between the end part and the elastic contact pieces and a region that includes a border
(Continued)

between the base part and the elastic contact pieces. The stress dispersion part protrudes in the same direction as an expanding direction in which the elastic contact pieces expand.

11 Claims, 10 Drawing Sheets

(58) Field of Classification Search
USPC ..... 439/884
See application file for complete search history.

(56) References Cited

U.S. PATENT DOCUMENTS 6,155,887 A * 12/2000 Cuff ..... H01R 12/585 439/751
6,866,523 B2 * 3/2005 Yamashita ..... H01R 12/58 439/79
7,037,146 B2 * 5/2006 Nakamura ..... H01R 12/585 439/751
7,048,595 B2 * 5/2006 Nakamura ..... H01R 12/585 439/75
7,083,434 B1 * 8/2006 Blossfeld ..... H01R 12/585 200/284
7,377,823 B2 * 5/2008 Chen ..... H01R 12/585 439/751
7,452,248 B2 * 11/2008 Seo ..... H01R 12/585 439/751
7,503,811 B2 * 3/2009 Seo ..... H01R 12/585 29/874
8,701,476 B2 * 4/2014 Prado ..... G01D 11/245 73/114.31
9,585,253 B2 * 2/2017 Matsumoto ..... H01R 12/71
2002/0037672 A1 * 3/2002 Min ..... H01R 12/585 439/751
2004/0145880 A1 7/2004 Watanabe et al.
2005/0087429 A1 4/2005 Blossfeld
2005/0165987 A1 7/2005 Ksano et al.

FOREIGN PATENT DOCUMENTS

JP 2008-165987 7/2008
JP 2012-169190 9/2012
WO 2008/038331 4/2008

* cited by examiner

PRESS-FIT TERMINAL

BACKGROUND

Field of the Invention

The technology disclosed herein relates to a press-fit terminal.

Related Art

One of conventionally known press-fit terminals is a press-fit terminal 100 that is fitted with pressure into a through-hole 121 of a wiring board 120 to be incorporated in an electronic device. The press-fit terminal 100 is electrically connected to a conductive circuit without soldering, and is brought into contact by elasticity with, and fixed to the wiring board 120 (see FIG. 10).

The press-fit terminal 100 includes a slit part 106 at a center of a tab terminal in a width direction, and a pair of beam members 103 that swells outward with the slit part 106 interposed therebetween. A contact part 105, which is the part of the beam members 103 with the largest outer width, is set such that the width thereof between the outer edge parts is larger than the inner diameter of the through-hole 121. By inserting the beam members 103 with pressure into the through-hole 121 while bending the beam members 103 into the slit part 106, the press-fit terminal 100 can be brought into elastic contact with, and electrically connected to the through-hole 121.

Examples of relevant references include Japanese Unexamined Patent Application Publication No. 2004-127610 and WO 2008/038331

In order for such a press-fit terminal 100 to have ensured connection reliability against an influence of temperature, vibration, or the like, it is necessary for an inner wall of the through-hole 121 to secure a certain degree or more of contact load. In order to increase the contact load, for example, the terminal 100 is increased in thickness or the beam member 103 is increased in width, so that the beam member 103 becomes more rigid.

Making the press-fit terminal 100 more rigid, however, the press-fit terminal 100 receives more stress (strain) as the beam member 103 is deformed when the press-fit terminal 100 is inserted into the through-hole 121. Such a stress concentrates on a part of the press-fit terminal 100 where the deformation starts as the press-fit terminal 100 is inserted into the through-hole 121, that is, a root part (part at an end of the slit part 106) on an end side of the beam member 103 in the inserting direction and also on a portion near an outer edge part that is stretched by the deformation (region indicated by W in FIG. 10). Such an excessive stress concentration results in a crack in the press-fit terminal or a damage of the press-fit terminal.

An object of the technology disclosed herein is to disperse the stress that applies to the press-fit terminal as the press-fit terminal is deformed when inserted into the through-hole.

SUMMARY

The technology disclosed herein is a press-fit terminal to be inserted into a through-hole provided to a circuit board, and electrically connected to the through-hole in a state of being in elastic contact with an inner wall of the through-hole. The press-fit terminal includes: an end part that is located at an end side in a direction where the press-fit terminal is inserted into the through-hole; a base part that is located at a side opposite to the end part; a pair of elastic contact pieces that is disposed to face each other through an opening, is located between the end part and the base part to link the end part and the base part, and expands outward; and a stress dispersion part provided in at least one of a region including a border part between the end part and the elastic contact pieces and a region including a border part between the base part and the elastic contact pieces, the stress dispersion part protruding in a same direction as an expanding direction where the elastic contact pieces expand.

In this configuration, by the stress dispersion part provided to a part of the press-fit terminal that starts to be deformed particularly when the press-fit terminal is inserted into the through-hole, that is, at least one of the region including the border part between the end part and the elastic contact pieces and the region including the border part between the base part and the elastic contact pieces, the stress which has conventionally been concentrated on that position is dispersed. The mechanism is considered as below.

That is to say, when the press-fit terminal includes, in the part where the stress is concentrated, the stress dispersion part with the shape of protruding outward, the range of the region to receive the stress expands by the stress dispersion part. Thus, the stress (maximum value) applied per unit area is reduced. Accordingly, the stress that is generated with concentration can be dispersed.

The stress dispersion part may swell out in an arc-like shape to the expanding direction. In this configuration, the stress applied to the stress dispersion part can be dispersed more uniformly as compared to a configuration in which the stress dispersion part has, for example, a protruding shape with a corner, or a triangular protruding shape. The arc-like shape may be a curved shape or a planar shape with its both ends gradually continuing to the elastic contact piece and the end part or the base part.

In addition, the press fit terminal may further include an inner stress dispersion part that is provided at an inner peripheral edge part of a region of the opening where an inclination angle of the pair of elastic contact pieces changes, and that protrudes into the opening.

The press-fit terminal may further include: an elasticity applying part that is provided between the pair of elastic contact pieces, links the pair of elastic contact pieces, and applies elasticity; and an inner stress dispersion part that is provided at a border part of the elasticity applying part, the elastic contact pieces, and the opening, and that protrudes into the opening.

In this configuration, on the inner peripheral part of the opening that is stretched by the deformation when the press-fit terminal is inserted into the through-hole and that receives the large stress with concentration, the stress can be dispersed in a wide range. Therefore, the stress applied per unit area can be reduced.

Moreover, the inner stress dispersion part may swell out in an arc-like shape from the inner peripheral edge part of the opening. In this configuration, the stress applied to the stress dispersion part can be dispersed more uniformly as compared to a configuration in which the stress dispersion part has, for example, a protruding shape with a corner, or a triangular protruding shape. The arc-like shape may be a curved shape or a planar shape with its both ends gradually continuing to the elastic contact piece and the elasticity applying part.

Advantageous Effect of the Invention

According to the technology disclosed herein, the press-fit terminal that can disperse the stress caused by the deformation at the insertion into the through-hole can be obtained.

DETAILED DESCRIPTION

First Embodiment

Figure 1:
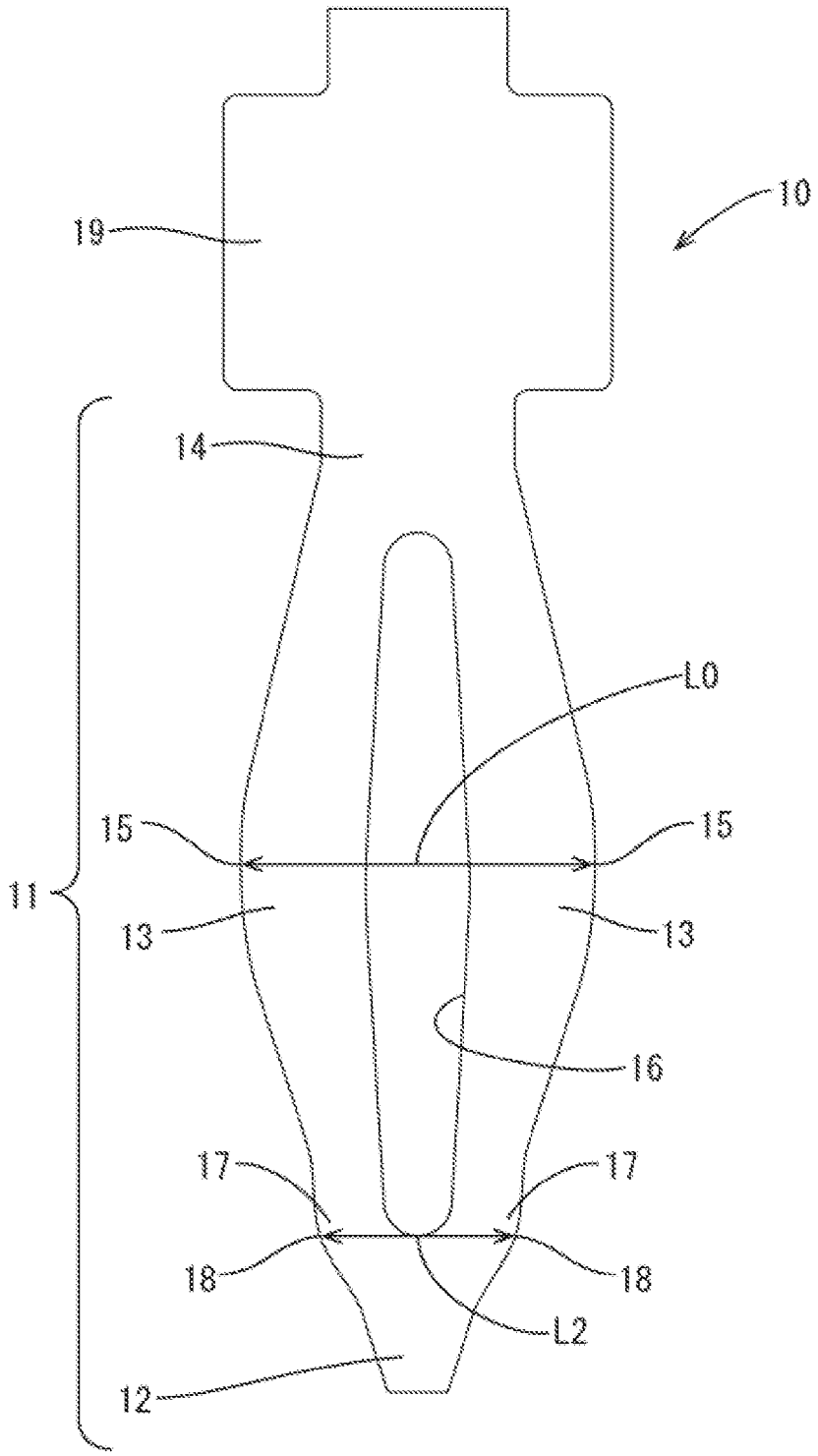
FIG. 1 is a plan view of a press-fit terminal according to a first embodiment.
Figure 2:
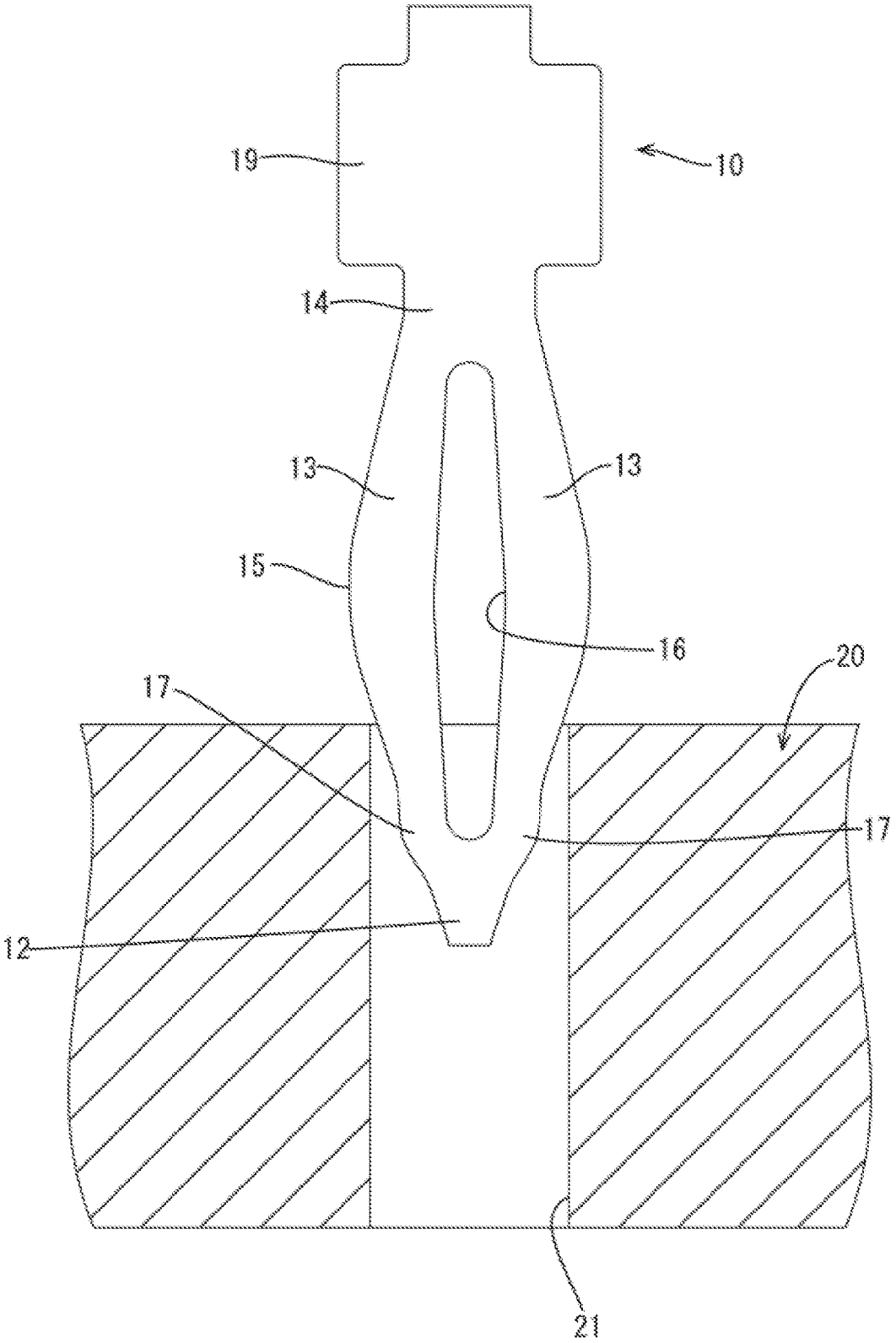
FIG. 2 is a plan cross-sectional view illustrating a process of inserting the press-fit terminal into a through-hole of a circuit board.
Figure 3:
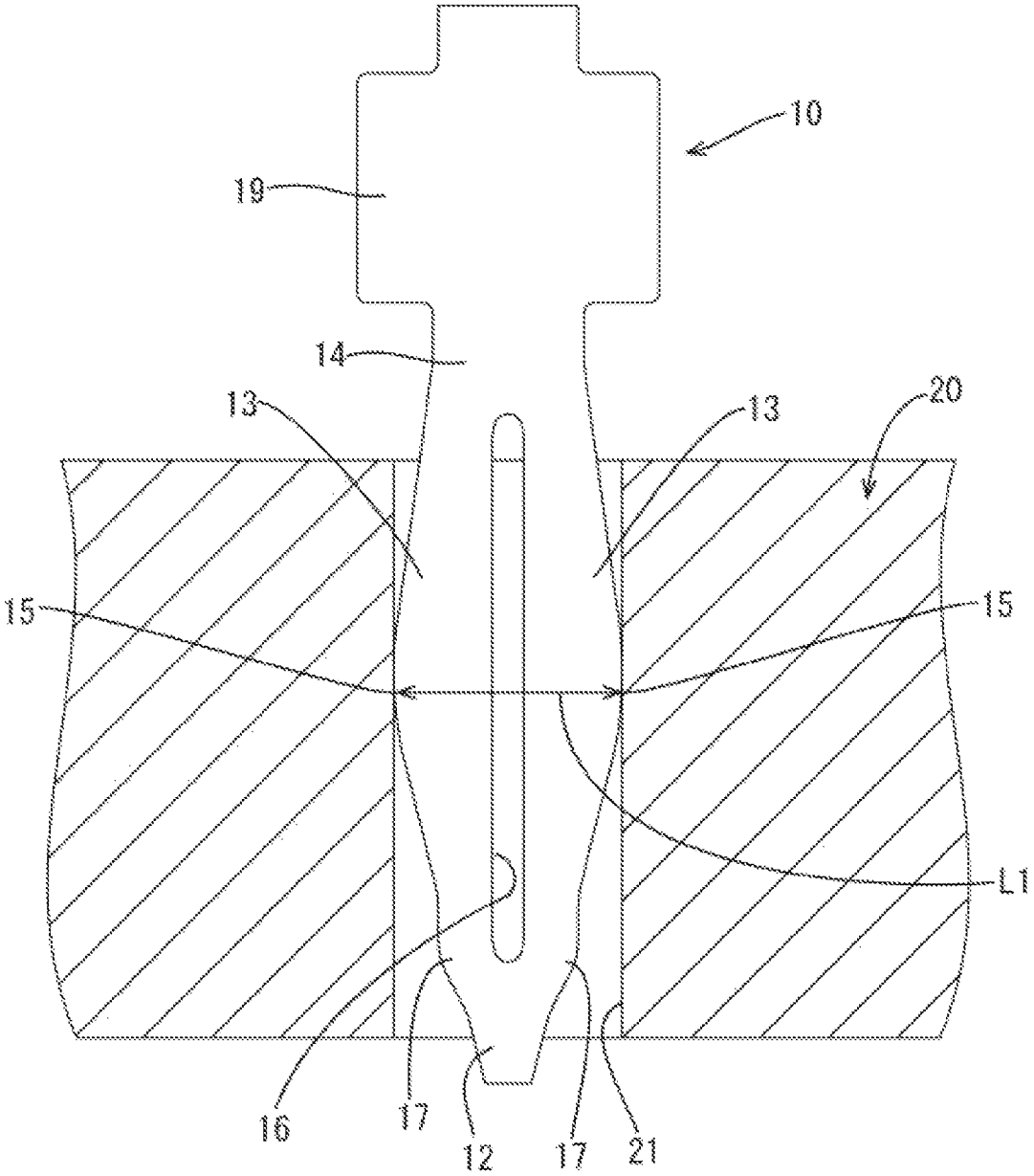
FIG. 3 is a plan cross-sectional view illustrating a state where the press-fit terminal is inserted into the through-hole of the circuit board.

A first embodiment is described with reference to FIG. 1 to FIG. 3.

A press-fit terminal 10 is to be fitted with pressure to a through-hole 21 of a circuit board 20, and is formed to have a long and thin tab shape as a whole by pressing a metal plate material with excellent conductivity, such as copper alloy. Note that, in FIG. 1, a lower side is the front (inserting direction) or an end side, and an upper side is the back.

The press-fit terminal 10 according to the present embodiment is a needle eye type press-fit terminal, and includes a terminal part 11 to be inserted into the through-hole 21 of the circuit board 20, and an attachment part 19 to be attached to another terminal that is not shown.

An end part 12 of the terminal part 11 on a tip end side (lower side in FIG. 1) is tapered to be guided into the through-hole 21 of the circuit board 20, and a side opposite to the end part 12 (upper side in FIG. 1) is a base part 14 connecting to the attachment part 19.

Between the end part 12 and the base part 14 in the terminal part 11, a pair of elastic contact pieces 13 is provided. The elastic contact pieces 13 link the end part 12 and the base part 14, and expand outward in a mountain-like shape. An outer side edge part of the elastic contact piece 13 connects to a side edge part of the end part 12 that narrows down toward an end, and gradually expands outward (expanding direction) toward the back. A central part of the elastic contact piece 13 in a front-back direction is a peak part 15 that expands outward most. A part behind the peak part 15 is gradually reduced in diameter, and connects to a side edge part of the base part 14 that is slightly reduced in diameter toward the back.

Between the pair of elastic contact pieces 13, an opening 16 is formed. The opening 16 has a long hole shape and is extended in the front-back direction. That is to say, the pair of elastic contact pieces 13 is disposed to face each other through the opening 16. The width of the opening 16 is set such that a central part in the front-back direction is slightly wider.

A part of the pair of elastic contact pieces 13 that expands outward most, that is, the peak parts 15 is at the same position as the wide part of the opening 16 in the front-back direction. The width of each elastic contact piece 13 is set such that the central part in the front-back direction (at the position of the peak part 15) is wide and both end parts (front end and rear end) are narrow.

The press-fit terminal 10 according to the present embodiment includes a stress dispersion part 17 that swells out outward from the side edge part (direction where the elastic contact pieces 13 expand) in a region including a border part between the end part 12 and the elastic contact piece 13, that is, at a position corresponding to an end of the opening 16 in the front-back direction. The stress dispersion part 17 swells out in an arc-like shape in which its both ends gradually continue to the end part 12 and the elastic contact piece 13, that is, in a shape like a gradient mountain.

More specifically, the stress dispersion part 17 includes an outer edge part formed of a smooth curved surface, and both a border part between the stress dispersion part 17 and the end part 12 and a border part between the stress dispersion part 17 and the elastic contact piece 13 are formed of a smooth curved surface.

A dimension L2 between a pair of peak parts 18 of the stress dispersion parts 17 is set to be smaller than a dimension L0 between the pair of peak parts 15 of the elastic contact pieces 13 in a natural state. In a state where the press-fit terminal 10 is inserted into the through-hole 21 of the circuit board 20, the press-fit terminal 10 is not in contact with an inner wall of the through-hole 21. That is to say, the dimension L2 between the pair of peak parts 18 of the stress dispersion parts 17 is smaller than an inner diameter L1 of the through-hole 21.

Note that the end part 12, the pair of elastic contact pieces 13, the base part 14, the stress dispersion parts 17, and the attachment part 19 are all formed to have a plate shape with the equal thickness on the same plane.

Next, an operation of the press-fit terminal 10 according to the present embodiment is described. As illustrated in FIG. 2, inserting the press-fit terminal 10 into the through-hole 21 of the circuit board 20 from the end part 12 side causes the side edge parts of the pair of elastic contact pieces 13 on the end side to abut on the opening edge part of the through-hole 21. As the press-fit terminal 10 is inserted further into the through-hole 21, the side edge parts of the elastic contact pieces 13 are pressed against the opening edge part of the through-hole 21 to cause the elastic contact pieces 13 to enter the through-hole 21 while being bent gradually in the opening 16.

When the peak parts 15 of the pair of elastic contact pieces 13 have passed the opening edge part of the through-hole 21, the peak parts 15 are pressed against the inner wall of the through-hole 21. In addition, by inserting the press-fit terminal 10 further to a predetermined position, the inside of the through-hole 21 and the press-fit terminal 10 are brought into electrical connection at a correct position (see FIG. 3).

When the pair of elastic contact pieces 13 is pressed against the inner wall of the through-hole 21 and deformed, a large stress is concentrated particularly on a part of the press-fit terminal 10 that starts to be deformed, that is, the border part between the end part 12 and the elastic contact piece 13 and near the outer edge part that is stretched by the deformation.

The press-fit terminal 10 according to the present embodiment, however, includes the stress dispersion part 17 in the part where the large stress would be applied. Therefore, differently from the conventional case in which the stress is concentrated on one place, the stress can be dispersed and the stress applied per unit area can be reduced. As a result, the crack or damage in the press-fit terminal 10 can be suppressed.

Second Embodiment

Figure 4:
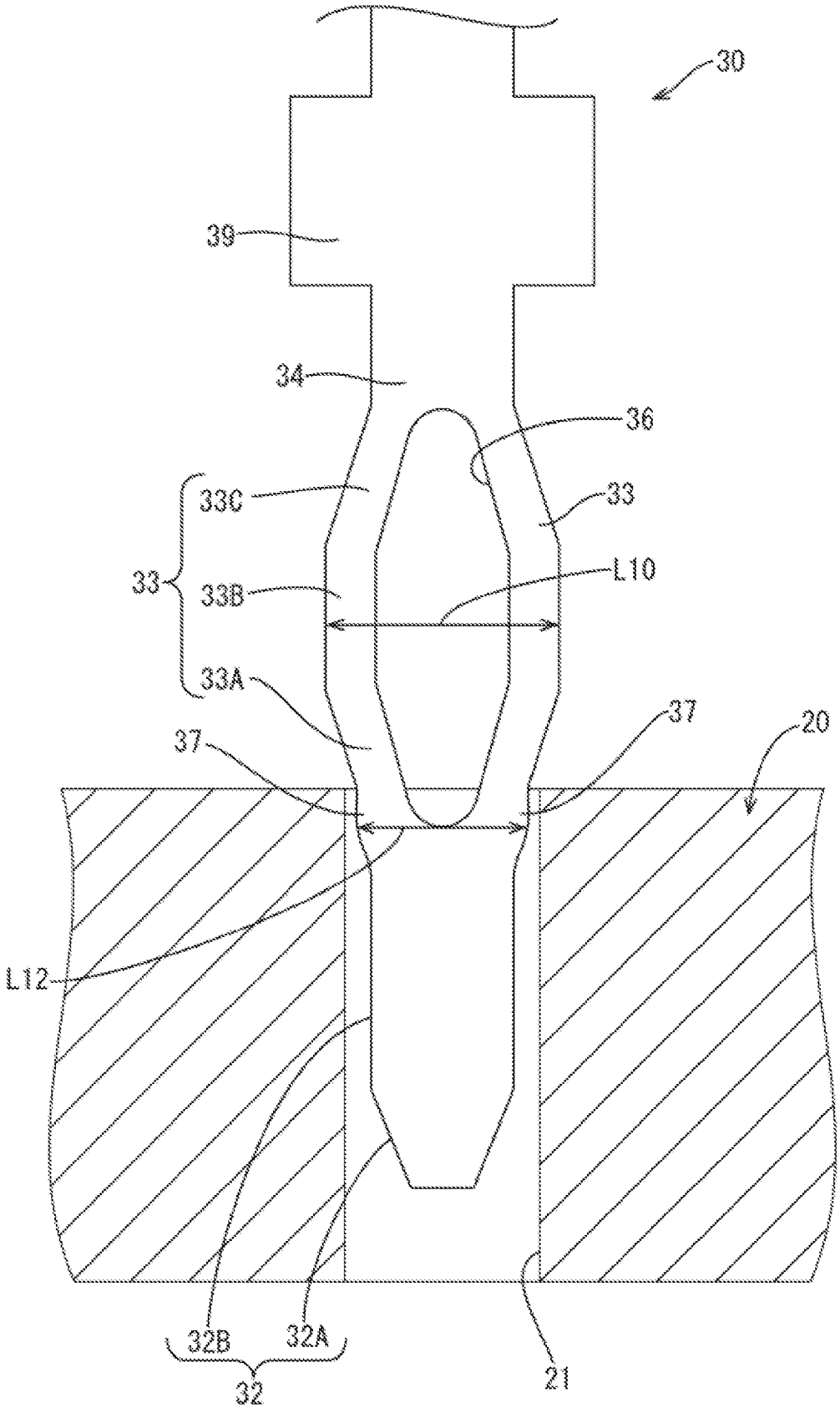
FIG. 4 is a plan cross-sectional view illustrating a process of inserting a press-fit terminal according to a second embodiment into the through-hole of the circuit board.
Figure 5:
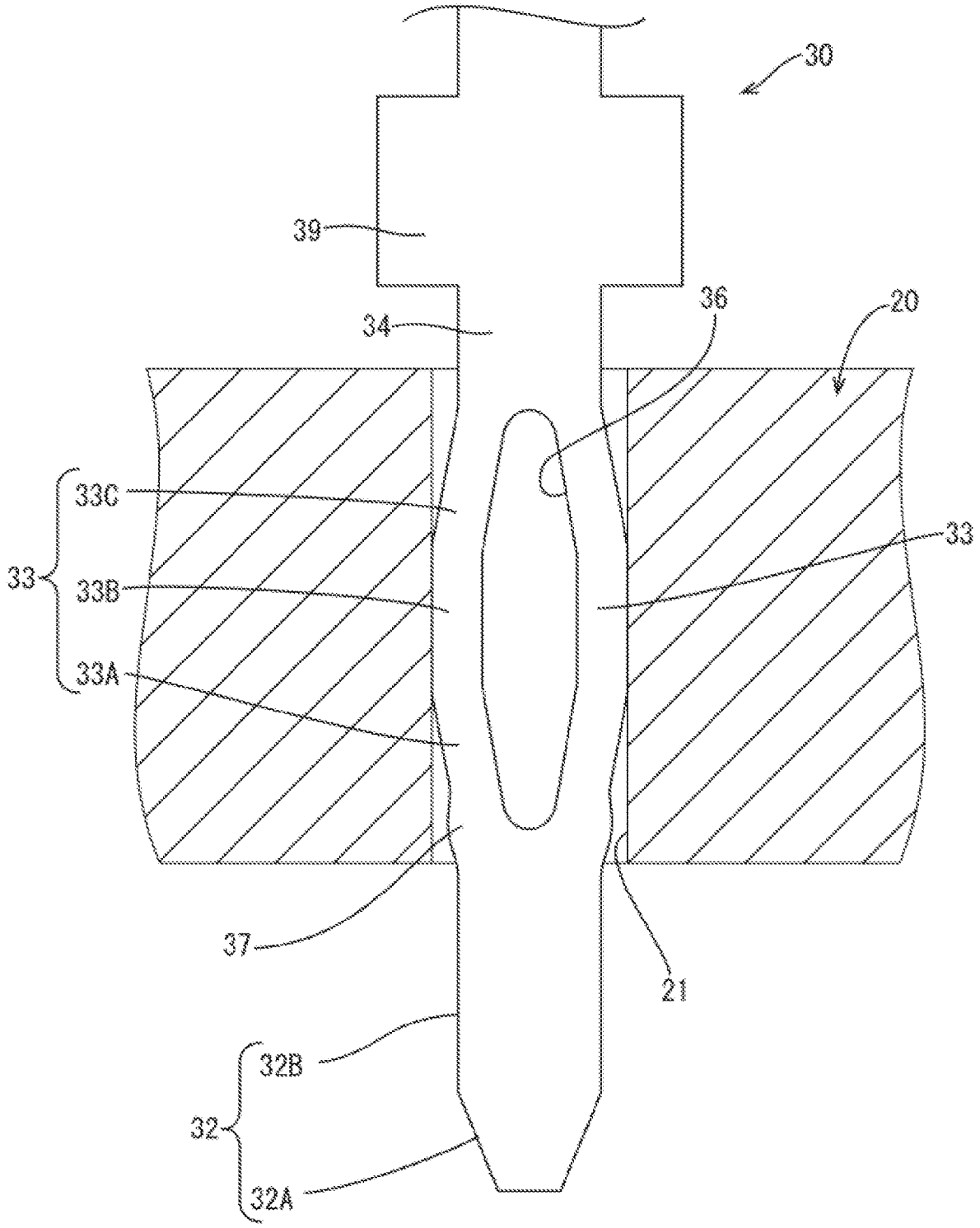
FIG. 5 is a plan cross-sectional view illustrating a state where the press-fit terminal is inserted into the through-hole of the circuit board.

Next, a second embodiment according to the present invention is described with reference to FIG. 4 and FIG. 5. Note that only a configuration that is different from that in the first embodiment is described below. The configurations similar to those in the first embodiment are denoted by the reference numeral of the configuration in the first embodiment to which 20 is added.

A press-fit terminal 30 according to the present embodiment is different from the press-fit terminal 10 according to the first embodiment described above in a form of an end part and an elastic contact piece.

Specifically, the press-fit terminal 30 according to the present embodiment includes a pair of elastic contact pieces 33 that has substantially the same width in the front-back direction at any position. In other words, an inner peripheral edge of an opening 36 is set to be extended along an outer side edge part of the pair of elastic contact pieces 33.

In addition, the pair of elastic contact pieces 33 includes a first inclined part 33A that gradually expands from the end side to the back, a contact part 33B that is extended along the axial direction (front-back direction, inserting direction) in connection to the first inclined part 33A, and a second inclined part 33C that is reduced in diameter gradually to the back in connection to the contact part 33B.

In addition, an end part of a terminal part 31 according to the present embodiment is an insertion guide part 32. The insertion guide part 32 includes a posture guide part 32B that is extended in the axial direction (to the front) from the end of the elastic contact piece 33, and a position guide part 32A that narrows down from an end of the posture guide part 32B to the front.

The press-fit terminal 30 according to the present embodiment also includes a stress dispersion part 37 in a region including a border part between the insertion guide part 32 and the elastic contact piece 33, that is, at a position corresponding to the end of the opening 36 in the front-back direction. The stress dispersion part 37 swells out outward from the side edge part (direction where the elastic contact pieces 33 expands). The stress dispersion part 37 also swells out in an arc-like shape in which its both ends gradually continue to the insertion guide part 32 and the elastic contact piece 33, that is, in a shape like a gradient mountain. A dimension L12 between a pair of peak parts of the stress dispersion parts 37 is set to be smaller than a dimension L10 between the pair of contact parts 33B of the elastic contact pieces 33 in a natural state. In a state where the press-fit terminal 30 is inserted into the through-hole 21 of the circuit board 20, the press-fit terminal 30 is not in contact with the inner wall of the through-hole 21. That is to say, the dimension L12 between the pair of peak parts of the stress dispersion parts 37 is smaller than the inner diameter of the through-hole 21.

In the present embodiment, the insertion guide part 32, the pair of elastic contact pieces 33, the base part 34, the stress dispersion part 37, and the attachment part 39 have a plate shape with the equal thickness on the same plane.

The press-fit terminal 30 according to the present embodiment includes the stress dispersion part 37 in a part where the large stress concentrates due to the deformation at the insertion into the through-hole 21 similarly to the first embodiment. Therefore, the generated stress can disperse to a wider range, and the stress applied per unit area can be reduced. As a result, the crack or damage caused in the press-fit terminal 30 can be suppressed.

Third Embodiment

Figure 6:
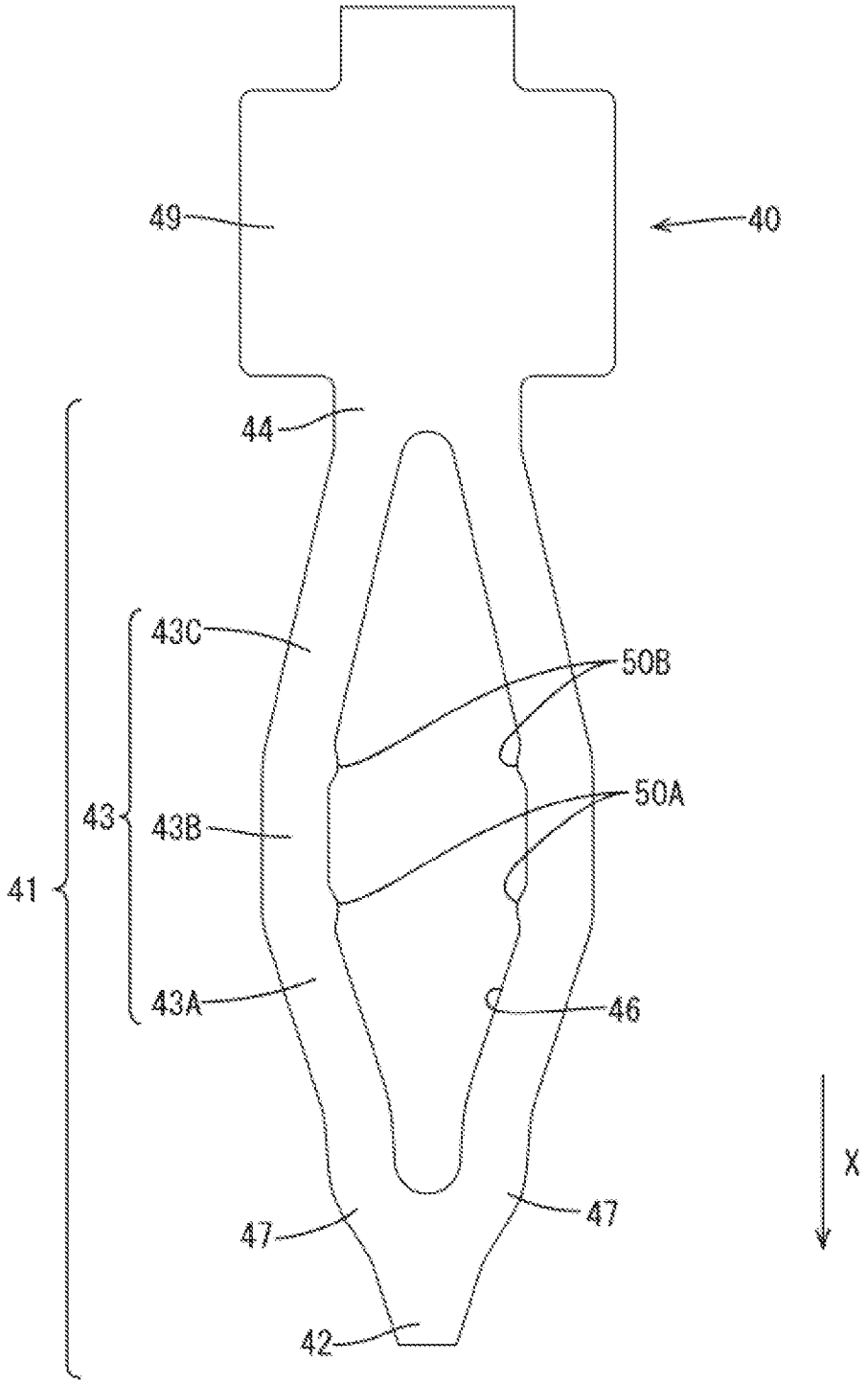
FIG. 6 is a plan view of a press-fit terminal according to a third embodiment.

Next, a third embodiment is described with reference to FIG. 6. Note that only a configuration that is different from that in the first embodiment is described below. The configurations similar to those in the first embodiment are denoted by the reference numeral of the configuration in the first embodiment to which 30 is added.

A press-fit terminal 40 according to the present embodiment includes an inner stress dispersion part 50 in addition to the press-fit terminal according to the first embodiment.

A pair of elastic contact pieces 43 of the press-fit terminal 40 according to the present embodiment is, similarly to the second embodiment, set such that the elastic contact pieces 43 have substantially the same width at any position in the front-back direction. That is to say, an inner peripheral edge part of an opening 46 (inner side edge part of the elastic contact piece 43) is set to be extended substantially along an outer side edge part of the pair of elastic contact pieces 43.

The pair of elastic contact pieces 43 includes a first inclined part 43A that gradually expands from the end side to the back, a contact part 43B that is extended along the axial direction (front-back direction, inserting direction X) in connection to the first inclined part 43A, and a second inclined part 43C that is reduced in diameter gradually to the back in connection to the contact part 43B. The first inclined part 43A and the second inclined part 43C are extended in a direction intersecting with the inserting direction X where the press-fit terminal 40 is inserted into the through-hole 21.

In a border part between the first inclined part 43A and the contact part 43B, that is, a region at a rear end of the first inclined part 43A where the inclination angle of the elastic contact piece 43 changes, a first inner stress dispersion part 50A that protrudes into the opening 46 is formed. The first inner stress dispersion part 50A swells out in an arc-like shape in which its both ends gradually continue to the first inclined part 43A and the contact part 43B from the inner peripheral edge part of the opening 46 to the inside, that is, in a shape like a gradient mountain.

In a border part between the contact part 43B and the second inclined part 43C, that is, a region at a front end of the second inclined part 43C where the inclination angle of the elastic contact piece 43 changes, a second inner stress dispersion part 50B that protrudes into the opening 46 is formed. The second inner stress dispersion part 50B swells out in an arc-like shape in which its both ends gradually continue to the contact part 43B and the second inclined part 43C from the inner peripheral edge part of the opening 46 to the inside, that is, in a shape like a gradient mountain.

The press-fit terminal 40 according to the present embodiment includes, in addition to the stress dispersion part similarly to the first embodiment, the inner stress dispersion parts 50A and 50B inside the border part between the first inclined part 43A and the contact part 43B (region where the inclination angle changes) and inside the border part between the contact part 43B and the second inclined part 43C (region where the inclination angle changes) that are stretched by the deformation at the insertion into the through-hole 21 such that a large stress is generated with concentration. Therefore, the stress generated on the inner periphery of the opening 46 can be dispersed in a wide range, and accordingly, the stress applied per unit area can be reduced.

Fourth Embodiment

Figure 7:
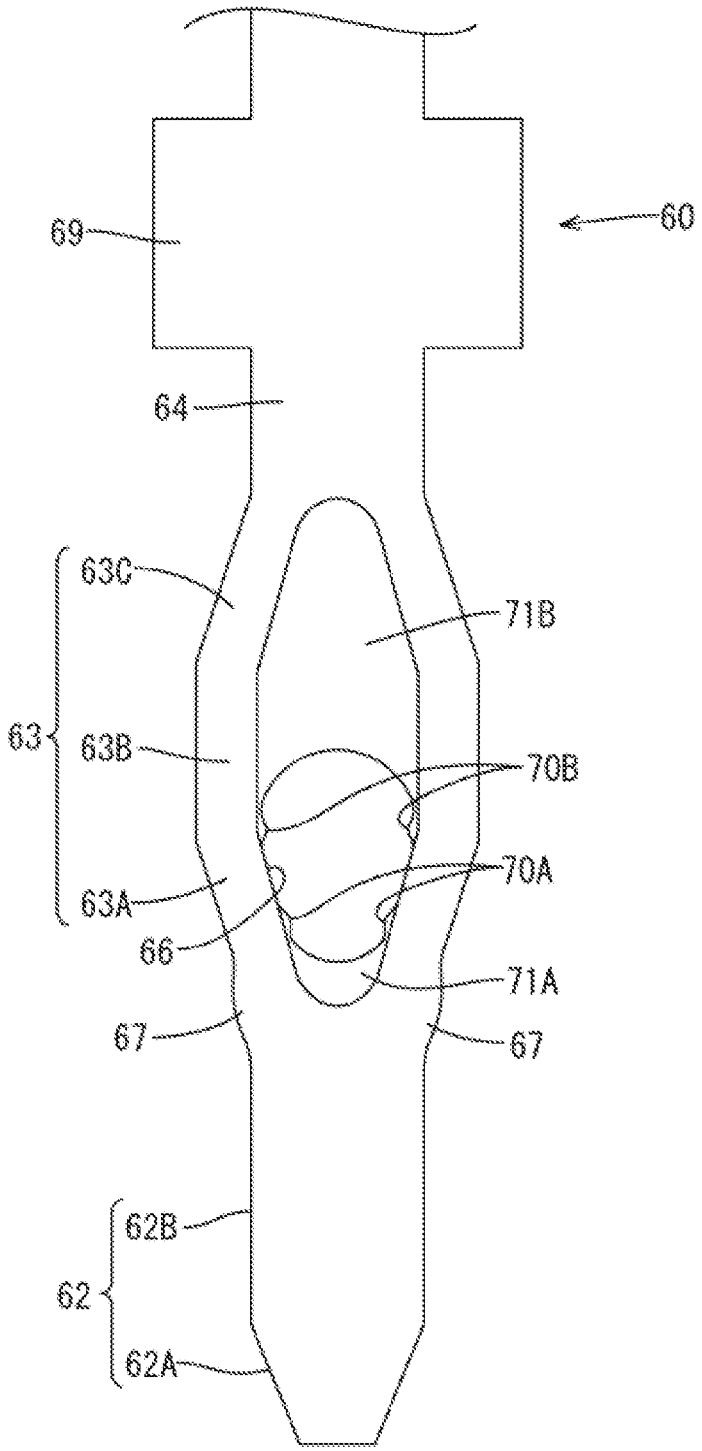
FIG. 7 is a plan view of a press-fit terminal according to a fourth embodiment.
Figure 8:
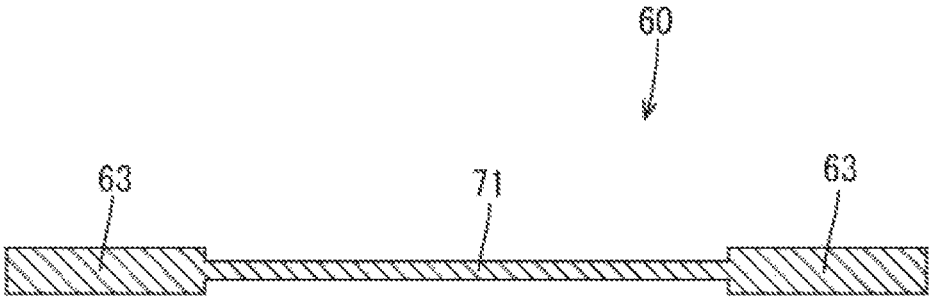
FIG. 8 is a cross-sectional view of the press-fit terminal.

Next, a fourth embodiment is described with reference to FIG. 7 and FIG. 8. Note that only a configuration that is different from that in the second embodiment is described below. The configurations similar to those in the second embodiment are denoted by the reference numeral of the configuration in the second embodiment to which 30 is added.

A press-fit terminal 60 according to the present embodiment includes, in addition to the press-fit terminal 30 according to the second embodiment, an elasticity applying part 71 that applies the elasticity to a pair of elastic contact pieces 63, and an inner stress dispersion part 70.

Specifically, in end side regions of first inclined parts 63A of the pair of elastic contact pieces 63, an end side elasticity applying part 71A is provided between the pair of first inclined parts 63A across the entire end regions to link the first inclined parts 63A. The end side elasticity applying part 71A has a plate shape that is thinner than the elastic contact piece 63, and as illustrated in FIG. 8, the end side elasticity applying part 71A is disposed at a central part of the pair of elastic contact pieces 63 in the thickness direction (height direction), so that the end side elasticity applying part 71A has a cross-sectional H shape as a whole. An edge part of the end side elasticity applying part 71A on an opening 66 side has a curved surface that is curved to the outside of the opening 66 and gradually continues to an inner peripheral edge part of the opening 66 as illustrated in FIG. 7.

On the other hand, in the entire region of contact parts 63B and second inclined parts 63C of the pair of elastic contact pieces 63, a base part side elasticity applying part 71B is provided between the pair of contact parts 63B and the pair of second inclined parts 63C to link the entire components. The base part side elasticity applying part 71B has a plate shape that is as thick as the end side elasticity applying part 71A, that is, thinner than the elastic contact piece 63, and is extended at the central part of the pair of elastic contact pieces 63 in the thickness direction (height direction) (see FIG. 8). In addition, an edge part of the base part side elasticity applying part 71B on the opening 66 side also has a curved surface that is curved to the outside of the opening 66 and gradually continues to the inner peripheral edge part of the opening 66 (see FIG. 7).

The press-fit terminal 60 according to the present embodiment includes a first inner stress dispersion part 70A that swells out into the opening 66 at a border part of the end side elasticity applying part 71A, the first inclined part 63A (elastic contact piece 63), and the opening 66. The first inner stress dispersion part 70A swells out in an arc-like shape in which its both ends gradually continue to the end side elasticity applying part 71A and the first inclined part 63A (elastic contact piece 63), that is, in a shape like a gradient mountain. The first inner stress dispersion part 70A is as thick as the end side elasticity applying part 71A, and is disposed on the same plane as the end side elasticity applying part 71A on the front and the back.

In addition, the base part side elasticity applying part 71B includes a second inner stress dispersion part 70B that swells out into the opening 66 at a border part between the opening 66 and a border part between the first inclined part 63A and the contact part 63B (elastic contact piece 63). The second inner stress dispersion part 70B also swells out in an arc-like shape in which its both ends gradually continue to the base part side elasticity applying part 71B and the first inclined part 63A (elastic contact piece 63), that is, in a shape like a gradient mountain. The second inner stress dispersion part 70B is as thick as the base part side elasticity applying part 71B, and is disposed on the same plane as the base part side elasticity applying part 71B on the front and the back.

The press-fit terminal 60 according to the present embodiment includes, in addition to the stress dispersion part similarly to the second embodiment, the inner stress dispersion parts 70 at particular parts on the inner peripheral side of the opening 66 where a large stress is generated with concentration due to the deformation at the insertion into the through-hole 21. Therefore, the generated stress can be dispersed in a wide range, and accordingly, the stress applied per unit area can be reduced.

Other Embodiments

The technology disclosed herein is not limited to the embodiments described above and with reference to the drawings. For example, the following embodiments may also be included in the technical scope.

(1) The press-fit shape in the above embodiments is a needle eye shape; however, the shape is not limited to the needle eye shape. For example, various kinds of press-fit shapes including S type, N type, H type, M type and ship type may be employed.

(2) In the above embodiments, the stress dispersion parts 17, 37, 47, and 67 are provided to the region including the border parts between the end parts 12 and 42 (insertion guide parts 32 and 62) and the elastic contact pieces 13, 33, 43, and 63; however, the similar stress dispersion parts may be provided to a region including border parts between the elastic contact pieces 13, 33, 43, and 63 and the base parts 14, 34, 44, and 64 or may be provided to both regions.

(3) In the first, second, and fourth embodiments, the stress dispersion parts 17, 37, and 67 swell out; therefore, the elastic contact pieces 13, 33, and 63 are wide at those positions. However, for example, as described in the third embodiment with reference to FIG. 6, the inner peripheral edge part of the opening 46 may be extended along the side edge part of the stress dispersion part 47 and the width of each elastic contact piece 43 may be equal to the width of the other part in another place where the stress dispersion part 47 is provided.

(4) The form of the stress dispersion part is not limited to the form described in the above embodiments. For example, the stress dispersion part may have a rectangular projecting shape in a plan view, a triangular shape, an ordinary arc-like shape, or any other shape.

(5) In the third embodiment, the elastic contact piece 43 includes the first inclined part 43A, the contact part 43B, and the second inclined part 43C, and the inner stress dispersion parts 50 are provided at the inner peripheral edge part of the border part between the first inclined part 43A and the contact part 43B and the border part between the contact part 43B and the second inclined part 43C in the opening 46.

However, the elastic contact piece may have a dog-leg shape without the contact part 43B, and the inner stress dispersion part may be provided at the border part between the first inclined part and the second inclined part (where the inclination angle changes).

(6) Alternatively, the elastic contact piece may have a form of being bent three or more times and the inner stress dispersion part may be provided to each bent part (where the inclination angle changes).

Figure 9:
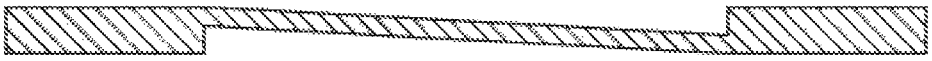
FIG. 9 is a cross-sectional view of a press-fit terminal according to another embodiment.
Figure 10:
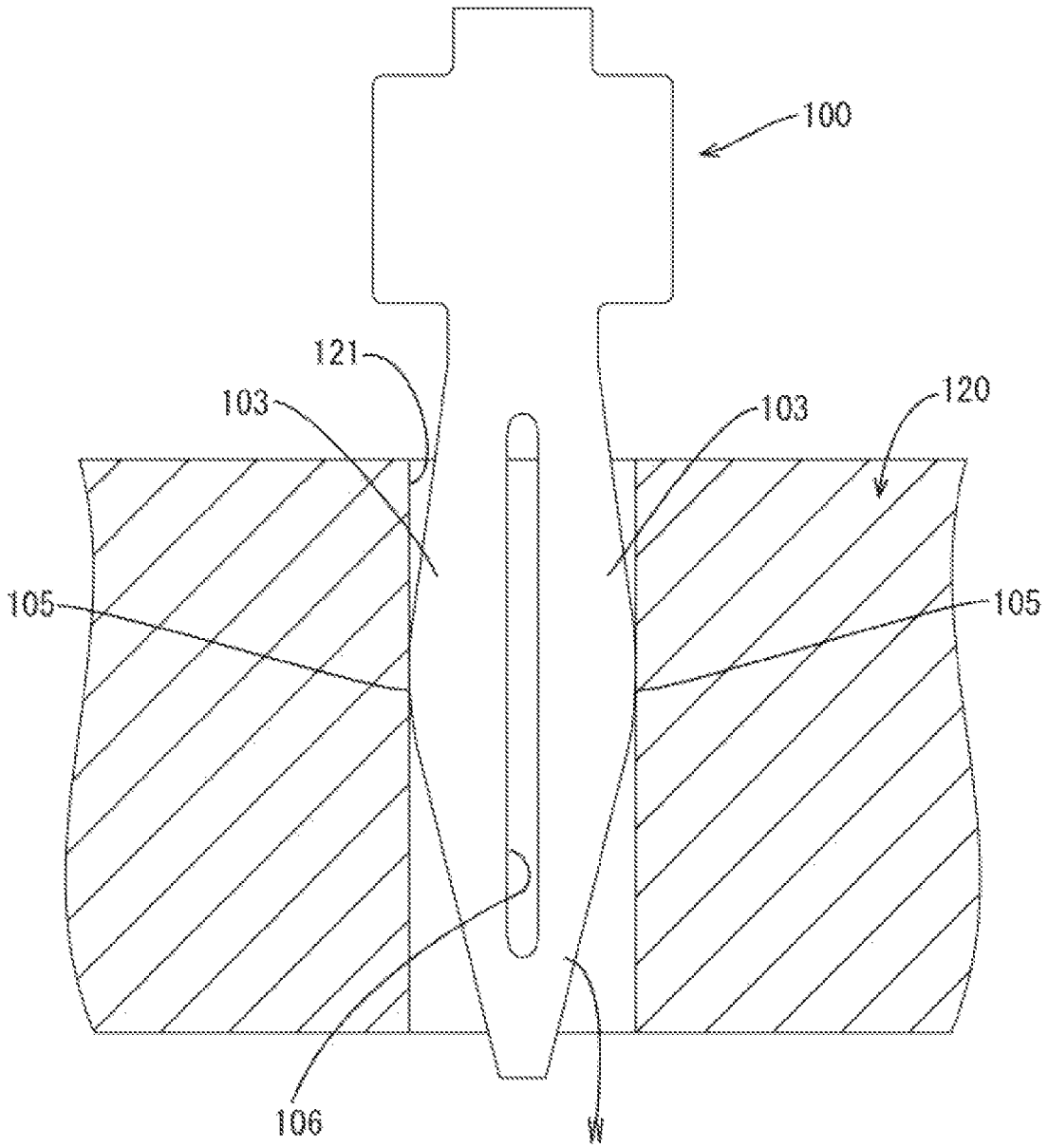
FIG. 10 is a plan cross-sectional view illustrating a state where a conventional press-fit terminal is inserted into a through-hole of a circuit board.

(7) In the fourth embodiment, the elasticity applying part 71 is disposed such that the cross section thereof, together with the elastic contact pieces 63, forms an H shape. However, the form of the elasticity applying part is not limited to that in the above embodiments. For example, as illustrated in FIG. 9, the cross section may be shaped like a letter N or the pair of elastic contact pieces may be intermittently connected. In short, the elasticity applying part may have any form that can improve the elasticity of the elastic contact piece.

EXPLANATION OF SYMBOLS

10, 30, 40, 60: Press-fit terminal
11, 31, 41, 61: Terminal part
12, 42: End part
13, 33, 43, 63: Elastic contact piece
14, 34, 44, 64: Base part
15: Peak part
16, 36, 46, 66: Opening
17, 37, 46, 67: Stress dispersion part
18: Peak part
20: Circuit board
21: Through-hole
32, 62: Insertion guide part (End part)
50, 70: Inner stress dispersion part
71: Elasticity applying part
X: Inserting direction

The invention claimed is:

1. A press-fit terminal to be inserted into a through-hole provided to a circuit board, and electrically connected to the through-hole in a state of being in elastic contact with an inner wall of the through-hole, the press-fit terminal comprising:

an end part that is located at a front in a direction where the press-fit terminal is inserted into the through-hole;

a base part that is located at a side opposite to the end part;

two elastic contact pieces that face each other through an opening, the two elastic contact pieces being located between the end part and the base part to link the end part and the base part, and the two elastic contact pieces expands outward;

a stress dispersion part provided in at least one of a region including a border part between the end part and the elastic contact pieces and a region including a border part between the base part and the elastic contact pieces, the stress dispersion part protruding in a same direction as an expanding direction where the elastic contact pieces expand; and the end part has a straight part extending from a tip of the elastic contact pieces toward the front.

2. The press-fit terminal according to claim 1, wherein the stress dispersion part swells out in an arc-like shape to the expanding direction.

3. The press-fit terminal according to claim 2, further comprising an inner stress dispersion part that is provided at an inner peripheral edge part of a region of the opening where an inclination angle of the pair of elastic contact pieces changes, and that protrudes into the opening.

4. The press-fit terminal according to claim 2, further comprising:

an elasticity applying part that is provided between the pair of elastic contact pieces, links the pair of elastic contact pieces, and applies elasticity; and an inner stress dispersion part that is provided at a border part of the elasticity applying part, the elastic contact pieces, and the opening, and that protrudes into the opening.

5. The press-fit terminal according to claim 4, wherein the inner stress dispersion part swells out in an arc-like shape from the inner peripheral edge part of the opening.

6. The press-fit terminal according to claim 3, wherein the inner stress dispersion part swells out in an arc-like shape from the inner peripheral edge part of the opening.

7. The press-fit terminal according to claim 1, further comprising an inner stress dispersion part that is provided at an inner peripheral edge part of a region of the opening where an inclination angle of the pair of elastic contact pieces changes, and that protrudes into the opening.

8. The press-fit terminal according to claim 1, further comprising:

an elasticity applying part that is provided between the pair of elastic contact pieces, links the pair of elastic contact pieces, and applies elasticity; and an inner stress dispersion part that is provided at a border part of the elasticity applying part, the elastic contact pieces, and the opening, and that protrudes into the opening.

9. The press-fit terminal according to claim 1, wherein the straight part has substantially parallel opposite side edges.

10. The press-fit terminal according to claim 9, further comprising a position guide part extending from the straight part to the front, the position guide part tapering to narrower widths from the straight part to the front.

11. The press-fit terminal according to claim 10, wherein the straight part and the position guide part have lengths extending in a direction extending from the base part to the end part, the length of the straight part being greater than the length of the position guide part.

* * * * *